US010871342B2

(12) United States Patent
Joplin et al.

(10) Patent No.: US 10,871,342 B2
(45) Date of Patent: Dec. 22, 2020

(54) BEDDING BLOCK FOR A RIFLE

(71) Applicant: AMERICAN PRECISION ARMS, LLC, Jefferson, GA (US)

(72) Inventors: Jered S. Joplin, Jefferson, GA (US); Robert B. Gradous, Hephzibah, GA (US)

(73) Assignee: AMERICAN PRECISION ARMS, LLC, Jefferson, GA (US)

( * ) Notice: Subject to any disclaimer, the term of this patent is extended or adjusted under 35 U.S.C. 154(b) by 0 days.

(21) Appl. No.: 16/707,843

(22) Filed: Dec. 9, 2019

(65) Prior Publication Data

US 2020/0132407 A1 Apr. 30, 2020

Related U.S. Application Data

(63) Continuation of application No. 16/299,836, filed on Mar. 12, 2019, now Pat. No. 10,539,387.

(60) Provisional application No. 62/641,989, filed on Mar. 12, 2018.

(51) Int. Cl.

| | |
|---|---|
| ***F41A 21/48*** | (2006.01) |
| ***F41C 23/00*** | (2006.01) |
| ***F41C 23/16*** | (2006.01) |

(52) U.S. Cl.

CPC ..... *F41A 21/487* (2013.01); *F41C 23/00* (2013.01); *F41C 23/16* (2013.01)

(58) Field of Classification Search

CPC .. F41A 9/48; F41A 9/485; F41A 9/487; F41A 21/48; F41A 21/485; F41A 21/487; F41C 23/00

See application file for complete search history.

(56) References Cited

U.S. PATENT DOCUMENTS

| | | | | |
|---|---|---|---|---|
| 2,717,465 | A * | 9/1955 | Clark, Jr. | F41C 23/00 42/75.01 |
| 3,439,441 | A * | 4/1969 | Lawley | F41C 23/00 42/75.01 |
| 3,842,527 | A * | 10/1974 | Low | F41A 21/482 42/75.02 |
| 4,385,464 | A * | 5/1983 | Casull | F41C 23/00 42/75.03 |
| 6,301,817 | B1 * | 10/2001 | Hogue | F41C 23/18 42/71.01 |
| 6,487,805 | B1 * | 12/2002 | Reynolds | F41A 21/485 42/75.03 |
| 8,881,444 | B2 * | 11/2014 | Warburton | F41A 11/00 42/74 |
| 9,341,436 | B2 * | 5/2016 | Frankel | F41C 23/00 |
| 9,625,224 | B2 * | 4/2017 | Olsen | F41A 3/66 |

(Continued)

OTHER PUBLICATIONS

Definition of "Interference Fit". <https://www.lexico.com/en/definition/interference_fit>. (Year: 2020).*

*Primary Examiner* — Gabriel J. Klein

(74) *Attorney, Agent, or Firm* — Eric B. Fugett; Mark A. Pitchford; Pitchford Fugett, PLLC

(57) ABSTRACT

A bedding block for mounting a barreled action for a rifle to a stock can include an elongated body configured to receive the barreled action for the rifle in a semicircular channel defined in top surface of the elongated body. The semicircular channel can have a first radius, the barreled action can have a second radius, and the first radius can be less than the second radius.

17 Claims, 10 Drawing Sheets

(56) References Cited

U.S. PATENT DOCUMENTS

| | | | | |
|---|---|---|---|---|
| 9,726,444 | B1 * | 8/2017 | Sisk | F41A 3/66 |
| 2011/0185618 | A1 * | 8/2011 | Jamison | F41A 21/00 42/75.03 |
| 2017/0314890 | A1 * | 11/2017 | Ludlow | F41A 21/48 |

* cited by examiner

BEDDING BLOCK FOR A RIFLE

CROSS-REFERENCES TO RELATED APPLICATIONS

This application is a continuation of U.S. patent application Ser. No. 16/299,836 entitled "Bedding Block for a Rifle" filed on Mar. 12, 2018, which claims priority to U.S. Provisional Patent Application No. 62/641,989 entitled "Bedding Block For a Rifle" filed on Mar. 12, 2018, all of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present disclosure relates generally to firearms. More particularly, the present disclosure relates to an apparatus and method for mounting a barreled action for a rifle to a stock or chassis.

A conventional rifle generally comprises groups of components, each one typically consisting of several additional subcomponents. These groups include, but are not limited to, the bolt assembly, the barreled action, the trigger group, and the stock. The stock provides a shooter a convenient member by which the rifle is typically carried and braced against a part of the shooter's body. A rifle stock typically has a rear shoulder support portion designed to be held against a shooter's shoulder during firing (i.e., the buttstock or butt), and a forward forearm support portion, that includes an appropriate recess or recesses, shaped and formed to receive, support, and carry the barreled action of the rifle (i.e., the forend).

Stability and maintenance of a precise action-to-stock fit is essential to accuracy of the rifle because a poor fit between the action and stock encourages movement of the action inside the stock during firing that can adversely affect projectile trajectory and thus accuracy and precision of shot placement over time. Similarly, when the action bolts or screws of a rifle suffering from an imperfect fit between its action and stock are tightened, the strain and stress placed on the action can likewise cause undesirable decreases in accuracy and precision.

Various methods and devices have been utilized to rigidly and stably bed or fit rifle actions and the attached barrels into a stock. One well known method involves the use of an epoxy composition or other bedding material to precisely secure or "bed" the action to the stock. However, this bedding method typically requires the services of a gunsmith, and the resulting stocks are permanently married to one particular action, and consequently only one cartridge and magazine configuration. If a shooter desires to utilize a different barreled action, such as one for a different caliber cartridge or a barreled action from a different manufacturer, an entirely different stock must be fitted to that action.

Another option for mounting or fitting a barreled action of a rifle to a rifle stock involves the use of an intermediate member known as a bedding block. However, currently available bedding blocks typically employ a channel having a V-shaped cross section to interface with the barreled action. Such bedding blocks do not permit an exact, stable, and lasting fit between the action and the stock. As a result, such bedding blocks tend to wear out or become loose over time, which allows the action of the rifle to move within the stock during firing and causes a decline in accuracy. Consequently, rifles constructed using currently available bedding blocks tend to require the use of additional bedding material around portions of the action to hold the action stationary within the bedding block. This is undesirable because it limits the versatility of the stock in which the bedding block is installed.

Accordingly, what is needed are improvements in apparatuses and methods for mounting an action for a rifle to a stock or chassis.

BRIEF SUMMARY

Aspects of the present disclosure overcome or minimize some or all of the shortcomings of the prior art by providing a bedding block for a rifle that includes multiple synergistic features that each contributes to increasing the accuracy of a rifle with which the bedding block is used. The bedding block disclosed herein is provided with a semicircular channel having an undersized radius and resilient sidewalls that eliminate movement of any barreled action fastened to a rifle stock in which the bedding block is secured and ensures a more stable and precise fit between a stock and the barreled actions of multiple different rifles, all without requiring the use of bedding material to hold the barreled action stationary within the channel of the bedding block. Consequently, the bedding block disclosed herein permits a shooter to use one stock assembly for multiple rifles while optimizing and maintaining the accuracy of any given rifle over time.

Accordingly, in one aspect, a bedding block for a rifle includes an elongated body configured to receive a barreled action for the rifle in a channel of the elongated body. The channel extends along a length of the elongated body and has a generally semicircular cross section. The semicircular cross section has a radius and a portion of the barreled action configured to interface with the elongated body defines another radius. The radius of the semicircular cross section is less than the radius of the barreled action.

In another aspect, a stock assembly configured to mount a barreled action for a rifle includes a stock having an elongated recess defined in an upper surface thereof and a bedding block rigidly secured in the elongated recess of the stock. The bedding block includes an elongated body configured to receive the barreled action for the rifle in a channel defined in the elongated body. The channel has a first radius, the barreled action has a second radius, and the first radius is less than the second radius.

In yet another aspect, a method of mounting a barreled action for a rifle to a stock comprises providing a bedding block including an elongated body configured to receive the barreled action for the rifle in a semicircular channel defined in the elongated body. The channel has a first radius, the action has a second radius, and the first radius is less than the second radius. The method further comprises providing a stock having a recess in which the bedding block is receivable, securing the bedding block in the recess of the stock, and fastening the barreled action for the rifle in the channel of the bedding block.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

Figure 1:
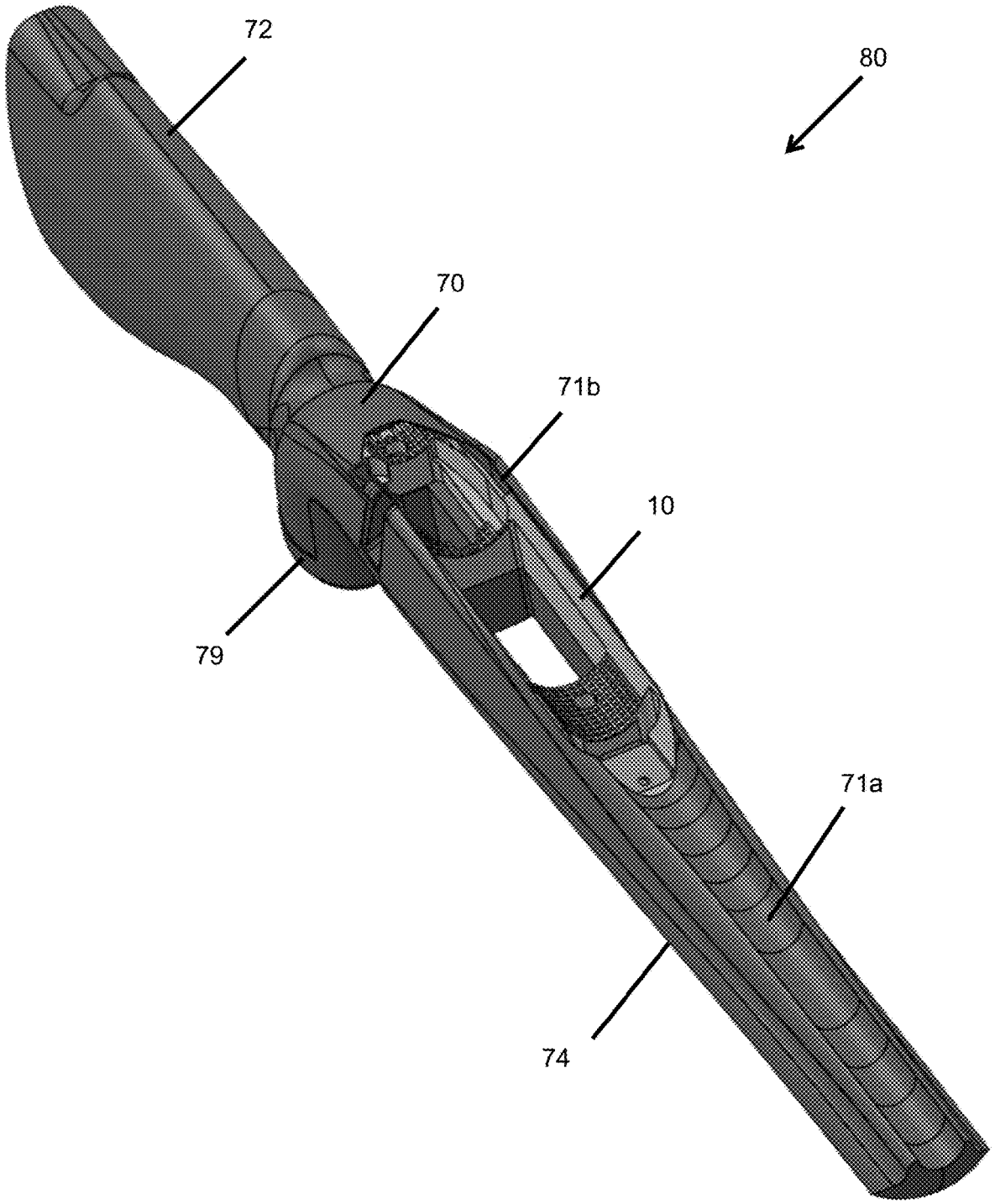
FIG. 1 is an elevated front perspective view of a stock assembly for a rifle formed in accordance with an embodiment of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. The words "vertical", "horizontal", "above", "below", "side", "top", "bottom" and other orientation terms are described with respect to this upright position during operation unless otherwise specified. A person of skill in the art will recognize that the apparatus can assume different orientations when in use. It is also contemplated that embodiments of the invention may be in orientations other than upright without departing from the spirit and scope of the invention as set forth in the appended claims.

The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component. Left and right are described with respect to a right-handed rifle. One of ordinary skill in the art will appreciate that features may be reversed from left to right to adapt the rifle or other subject matter to a left-handed shooter.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

As used herein, the terms "stock" and "chassis" are interchangeable. Although it is expected that the bedding block described herein will typically be used with traditional wooden and synthetic stocks comprising a butt and a forend, it is contemplated that the bedding block described herein may also be used with modern unibody and modular chassis formed from one or more metallic, synthetic, and natural materials.

As used herein, the term "rifle" means any long gun or handgun, whether a firearm or an airgun, having a rifled barrel and an action or receiver which mounts to a stock or chassis. Although it is expected that the bedding block described herein will typically be used with high-power bolt action rifles suitable for large game hunting or long range precision shooting, it is contemplated that the bedding block described herein may be used with any kind of firearm or airgun having a rifled barrel and a barreled action or receiver which mounts to a stock or chassis. For example, it is contemplated that the bedding block disclosed herein can be used with high-power, large caliber handguns and airguns.

Referring now to FIG. 1, an embodiment of a stock assembly 80 configured to mount a barreled action 85 for a rifle and formed in accordance with the present disclosure is shown. The stock assembly 80 includes a stock 70 for a rifle having a butt 72, a forend 74 opposite the butt 72, and a grip 79. A barrel channel 71*a* in which a barrel 86 for a rifle is receivable is formed in an upper surface of the forend 74. An elongated aperture or recess 71*b* (see FIG. 3) is formed in an upper surface of the stock 70 forward of the grip 79. The elongated recess 71*b* is adjacent to and rearward of the barrel channel 71*a*. A bedding block 10 formed in accordance with an embodiment of the present disclosure described in more detail below is secured in the elongated recess 71*b*. In some embodiments, the bedding block 10 can be secured in the elongated recess 71*b* of the stock 70 using a bedding epoxy or other bedding material. In other embodiments, the bedding block 10 can be secured in recess 71*b* by one or more fasteners, such as bolts or screws. In the upper surface of the bedding block 10 is formed a channel 24 in which a barreled action 85 for a rifle is removably receivable. The stock assembly 80 is assembled as a separate unit into which a separately assembled barreled action 85 for a rifle can be releasably fastened using a pair of action bolts or screws 78*a*, 78*b* native to the action selected to be fastened to the stock assembly 80.

Figure 2:
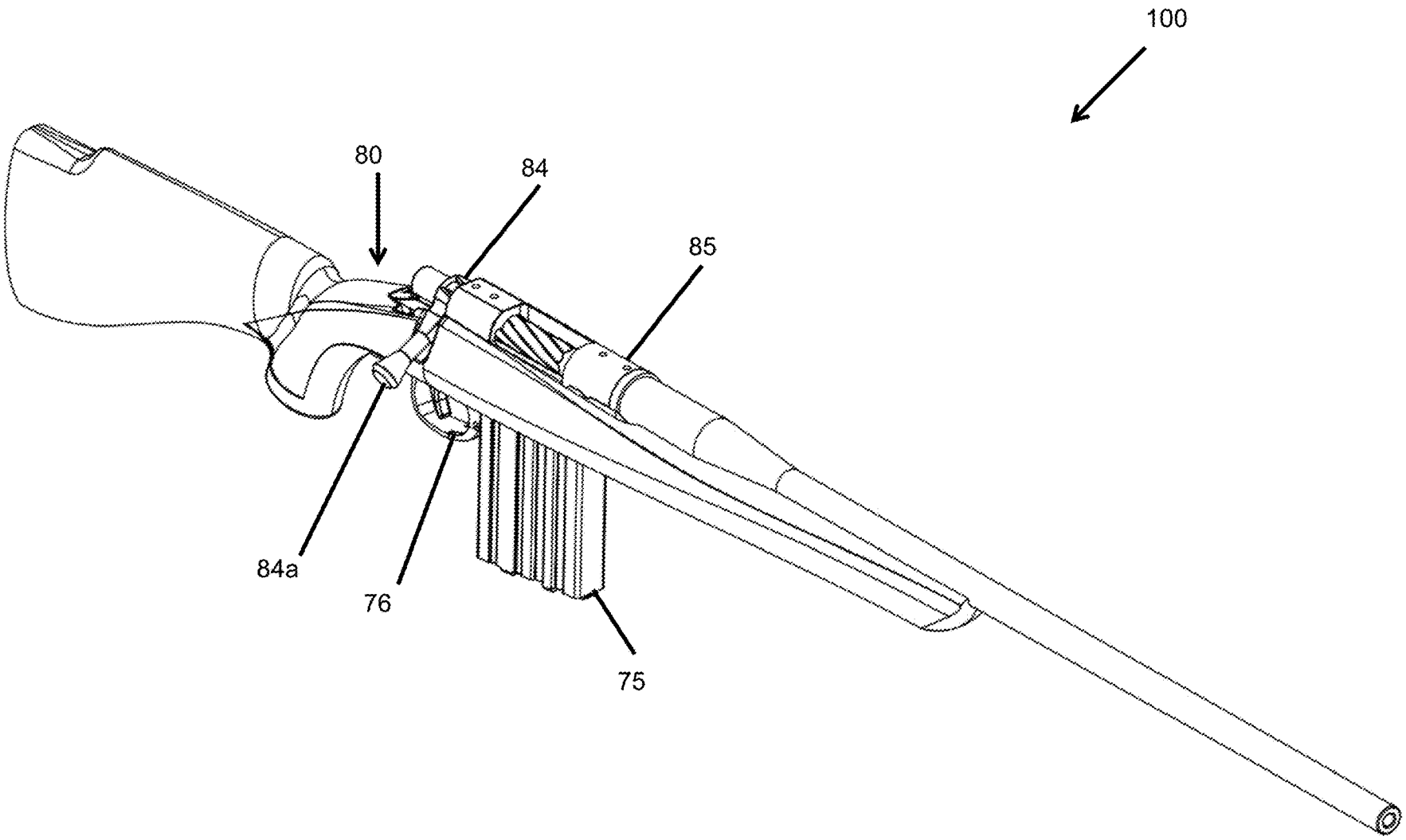
FIG. 2 is a front perspective view of an assembled bolt action rifle formed in accordance with an embodiment of the present disclosure showing the barreled action of the rifle mounted to the stock assembly of FIG. 1.

FIG. 2 shows the stock assembly 80 joined with a barreled action 85 housing a bolt assembly 84, and with a trigger group 73, an ammunition magazine 75, a trigger guard 76 installed to form an embodiment of an assembled bolt action rifle 100 constructed in accordance with the present disclosure. As best shown in the exploded view of FIG. 3, the barreled action 85 is assembled from an action 82, a barrel 86, and a recoil lug 88. With recoil lug 88 positioned over a portion of the rear end of barrel 86, the action 82 and barrel 86 are threaded together as single structural unit in a conventional manner well known to those of skill in the art. The barreled action 85 is releasably fastened to bedding block 10 using action screws 78*a*, 78*b*.

Referring to FIGS. 4-13, there is shown an embodiment of a bedding block 10 for a rifle formed in accordance with the present disclosure. The block 10 is configured to mount a barreled action 85 for a rifle to a stock 70 or chassis and eliminate movement of the barreled action inside the stock. This increases and maintains the accuracy and precision of the assembled rifle indefinitely. The bedding block 10 can be formed from any suitably strong, durable, and resilient material or combination of materials capable of withstanding the enormous forces resulting from repeated discharge of a firearm. Suitable metallic substances can include steel, aluminum, and aluminum alloys, among others. Suitable synthetic substances can include carbon fiber, among others.

The bedding block 10 includes an elongated body 12 having a length L, a width W, a forward end 14, and a rearward end 16 spaced from the forward end. The elongated body 12 also has a right side 18 and a left side 19 opposite the right side, as well as an upper surface 20 and a lower surface 22. The right and left sides 18, 19 of the elongated body 12 can be formed with grooves 48 or other concavities to facilitate ingress and thus superior adhesion of bedding material (e.g., epoxy) during installation of the bedding block 10 in a stock 70. The forward end 14 and rearward end 16 of the elongated body 12 can similarly include one or concavities, such as blind apertures 50, to further ensure that the bedding block 10 will remain firmly and lastingly secured immovably in the stock 70.

A channel 24 in which a barreled action 85 for a rifle 100 is removably receivable is formed in the upper surface 20 of the elongated body 12. The channel 24 extends along the length L of the elongated body 12 from the forward end 14 to the rearward end 16. The channel has a curved bottom surface 28 and curved opposing right and left sidewalls 18*a*, 19*a*, respectively, which extend generally upwardly from the bottom surface 28 and along a portion of the length L of the elongated body 12. In some embodiments, as best shown in FIGS. 4-6 and 12, the bottom surface 28 of the channel 24 can be provided with textural features designed to increase friction between the elongated body 12 and the smooth exterior surface of a barreled action 85 for a rifle with which the channel 24 is configured to interface. This provides the elongated body 12 improved purchase on the exterior surface of the barreled action 85 and creates a superior interface between the two. In certain embodiments, the textural features can be serrations, knurling, a series of interconnected grooves or channels forming a cross hatch pattern, or a combination of the foregoing.

Figure 8:
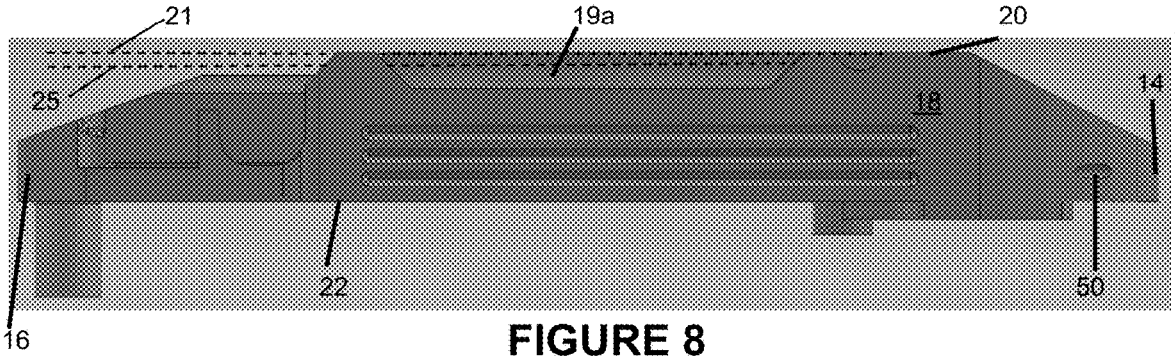
FIG. 8 is a right side elevational view of the bedding block of FIG. 4.
Figure 9:
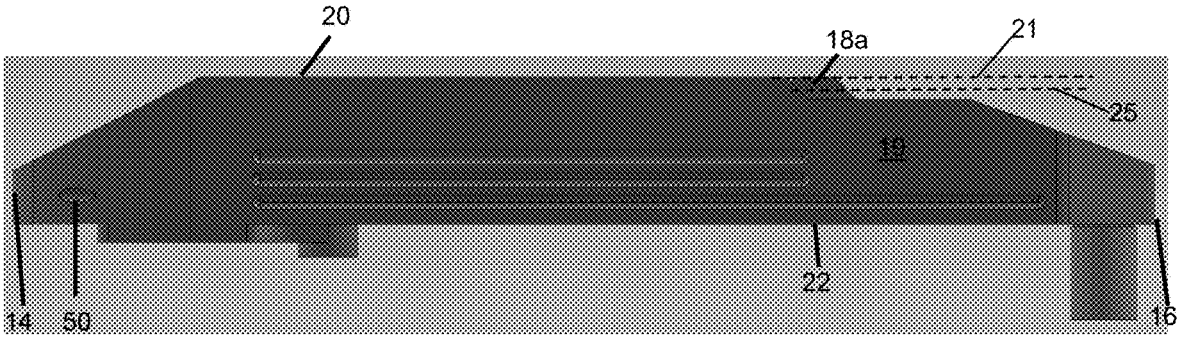
FIG. 9 is a left side elevational view of the bedding block of FIG. 4.
Figure 10:
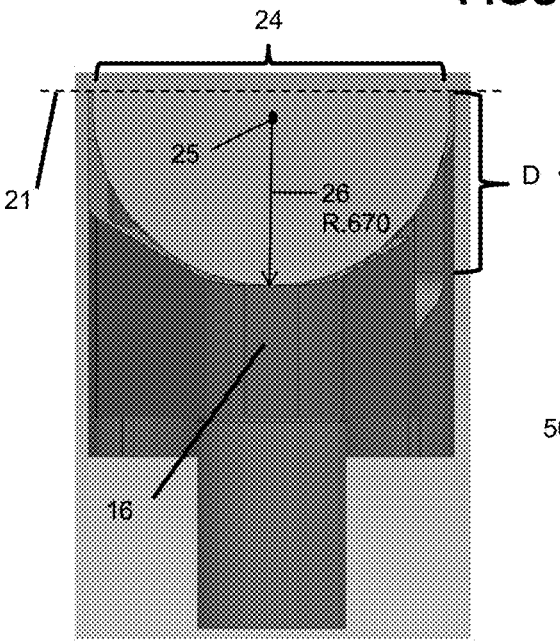
FIG. 10 is a rear elevational view of the bedding block of FIG. 4.
Figure 11:
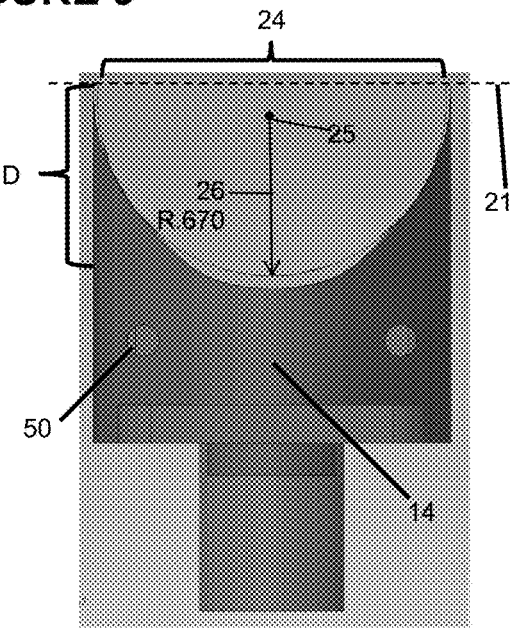
FIG. 11 is a front elevational view of the bedding block of FIG. 4.
Figure 12:
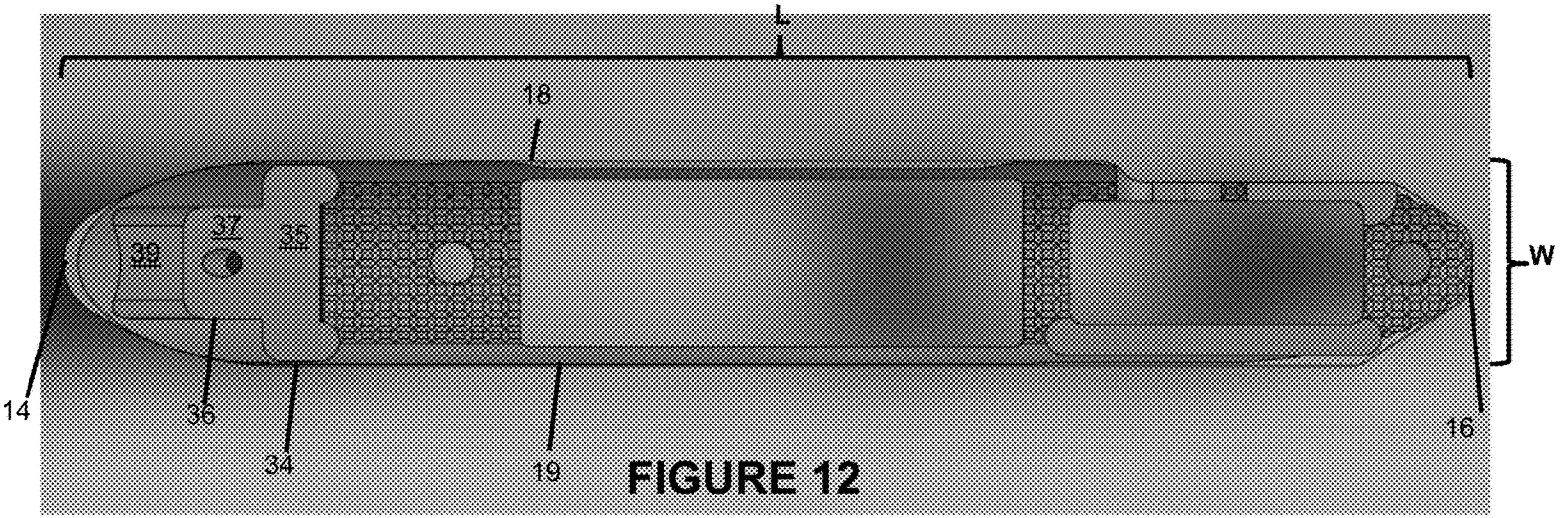
FIG. 12 is a top plan view of the bedding block of FIG. 4.
Figure 13:
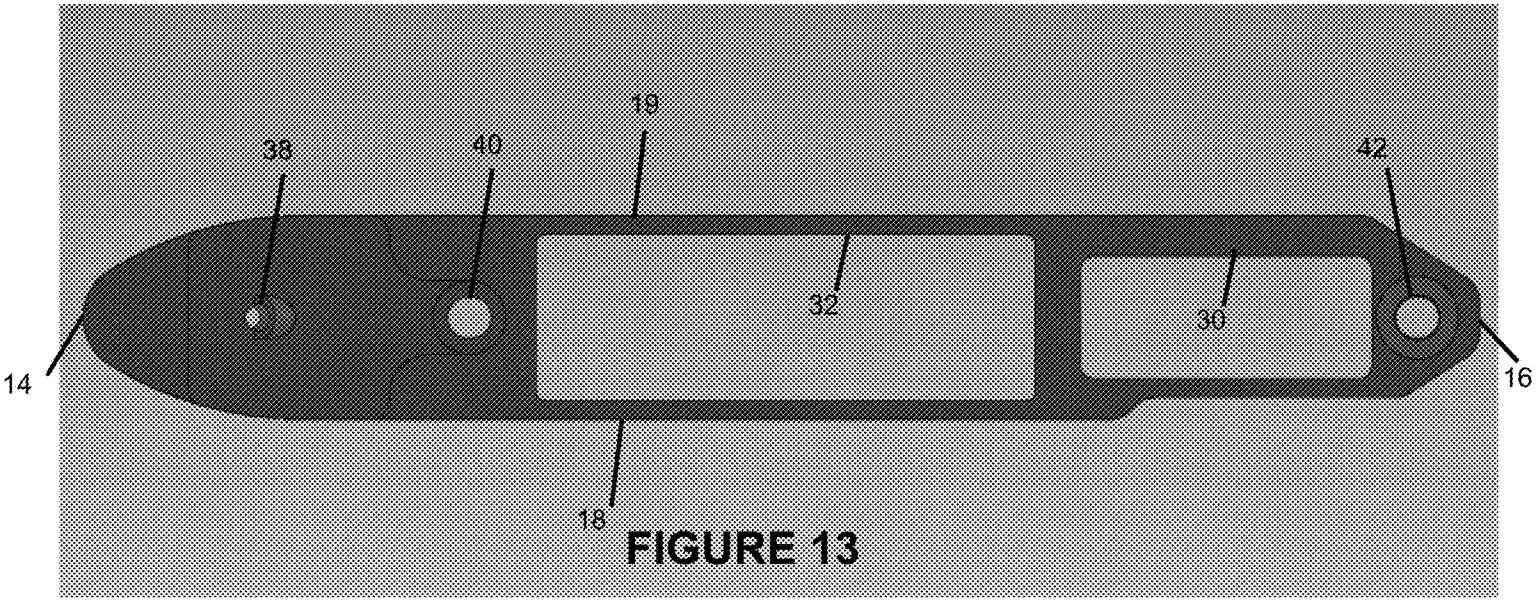
FIG. 13 is a bottom plan view of the bedding block of FIG. 4.

Turning to FIGS. 10-11, the channel 24 has a generally semicircular cross section. The generally circular cross section is defined by a radius of curvature 26 extending from a center of curvature 25 spaced above the bottom surface 28 of the channel 24. The center of curvature 25 extends longitudinally like an axis or centerline along the length of the channel 24 from the forward end 14 to the rearward end 16 of the elongated body 12, as best shown in FIGS. 8-9. In some embodiments, the radius of curvature 26 of the channel 24 can be from about 0.250 inches to about 2.000 inches. In some embodiments, the radius of curvature 26 of the channel 24 can be from about 0.500 inches to about 1.000 inches. In some embodiments, the radius of curvature 26 of the channel 24 can be from about 0.500 inches to about 0.750 inches. In some embodiments, the radius of curvature 26 of the channel 24 can be from about 0.600 inches to about 0.700 inches. In specific embodiments, the radius of curvature 26 of the channel 24 can be about 0.600, 0.650, 0.610, 0.615, 0.620, 0.625, 0.630, 0.635, 0.640, 0.645, 0.650, 0.655, 0.660, 0.665, 0.670, 0.675, 0.680, 0.685, 0.690, 0.695, or 0.700 inches. In a particular embodiment, the radius of curvature 26 can be about 0.670 inches.

Coordinately, the center of curvature 25 can be from about 0.250 inches to about 2.000 inches above the bottom surface 28 of the channel 24. In some embodiments, the center of curvature 25 can be from about 0.500 inches to about 0.750 inches above the bottom surface 28 of the channel 24. In some embodiments, the center of curvature 25 can be from about 0.600 inches to about 0.700 inches above the bottom surface 28. In specific embodiments, the center of curvature 25 of the channel 24 can be about 0.600, 0.650, 0.610, 0.615, 0.620, 0.625, 0.630, 0.635, 0.640, 0.645, 0.650, 0.655, 0.660, 0.665, 0.670, 0.675, 0.680, 0.685, 0.690, 0.695, or 0.700 inches above the bottom surface 28 of the channel 24. In a particular embodiment, the center of curvature 25 can be about 0.670 inches above the bottom surface 28 of the channel 24.

Referring again to FIGS. 8-11, the channel 24 has a depth D extending from the bottom surface 28 of the channel 24 to a horizontal plane 21 in which lie the uppermost edges of opposing sidewalk 18*a*, 19*a* (i.e., the uppermost surface of elongated body 12). The depth D of the channel 24 can be equal to or greater than the radius of curvature 26 of the channel. As a result, in some embodiments, the center of curvature 25 can lie in the same plane as the horizontal plane 21 containing the uppermost edges of opposing sidewalls 18*a*, 19*a*. In other embodiments, the center of curvature 25 can lie below the horizontal plane 21 containing the uppermost edges of opposing sidewalls 18*a*, 19*a*. Conversely, in some embodiments, the right and left sidewalls 18*a*, 19*a* can extend upwardly from the bottom surface 28 of the channel 24 above the center of curvature 25. However, in some embodiments, the right and left sidewalls 18*a*, 19*a* can extend upwardly from the bottom surface 28 of the channel 24 to the same elevational level as the center of curvature 25. In some embodiments, a portion of the right and left sidewalls 18*a*, 19*a* can extend above the center of curvature 25. In some embodiments, a portion of the right and left sidewalls 18*a*, 19*a* can extend above the center of curvature 25 from about 0.001 inches to about 0.100 inches. In some embodiments, a portion of the right and left sidewalls 18*a*, 19*a* can extend above the center of curvature 25 from about 0.005 inches to about 0.900 inches. In particular embodiments, a portion of the right and left sidewalls 18*a*, 19*a* can extend above the center of curvature 25 about 0.001, 0.002, 0.003, 0.004, 0.005, 0.006, 0.007, 0.008, 0.009, 0.010, 0.011, 0.012, 0.013, 0.014, 0.015, 0.016, 0.017, 0.018, 0.019, 0.020, 0.021, 0.022, 0.023, 0.024, 0.025, 0.026, 0.027, 0.028, 0.029, 0.030, 0.031, 0.032, 0.033, 0.034, 0.035, 0.036, 0.037, 0.038, 0.039, 0.040, 0.041, 0.042, 0.043, 0.044, 0.045, 0.046, 0.047, 0.048, 0.049, or 0.050 inches. In a particular embodiment, a portion of the right and left sidewalls 18*a*, 19*a* can extend above the center of curvature 25 by about 0.05 inches.

Although the radius of curvature 26 of the channel 24 can be varied to accommodate a barreled action 85 of any radius or diameter, it is to be understood that the radius 26 (and thus the diameter) of the channel 24 should be less than the radius (and thus the diameter) of the portion of the barreled action 85 which is to be seated in and interface with the channel. In combination with certain features of the sidewalls 18*a*, 19*a* further explained below, the undersized radius of curvature 26 (i.e., undersized compared to the radius of the portion of the barreled action 85 with which the channel 24 interfaces) simultaneously centers the barreled action within the channel 24 and creates an interference fit between the sidewalls 18*a*, 19*a* of the channel 24 and the barreled action 85 when the barreled action is seated in the channel. Accordingly, in some embodiments, the radius of curvature 26 of the channel 24 can be from about 0.25% to about 20% less than the corresponding radius of the barreled action 85 to be received in the bedding block 10. In some embodiments, the radius of curvature 26 of the channel 24 can be from about 0.50% to about 15% less than the corresponding radius of the barreled action 85 to be received in the bedding block 10. In other embodiments, the radius of curvature 26 of the channel 24 can be from about 1% to about 10% less than the corresponding radius of the barreled action 85 to be received in the bedding block 10. In a particular embodiment, the radius of curvature 26 of the channel 24 can be from about 1% to about 5% less than the corresponding radius of the barreled action 85 to be received in the bedding block 10.

Figure 16:
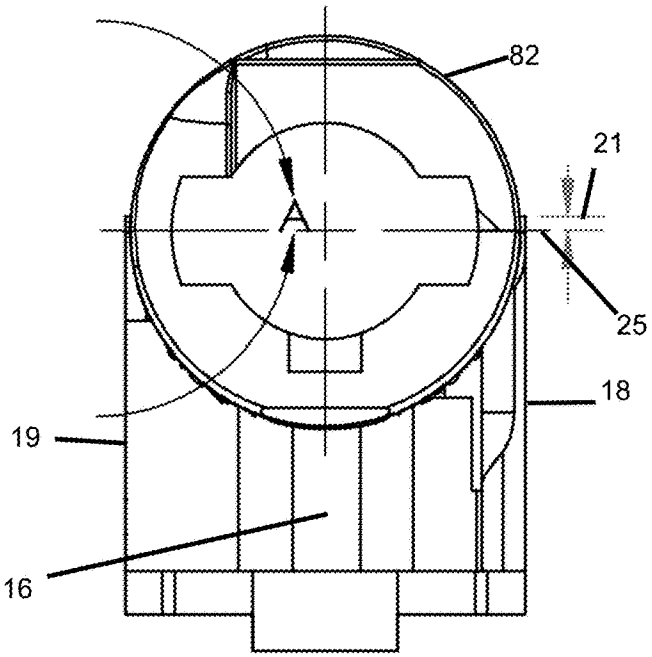
FIG. 16 is a rear elevational view of the barreled action and bedding block shown in FIG. 14 with the bolt removed to illustrate the fit between the exterior surface of the barreled action and the channel of the bedding block.

Additionally, as is best seen in FIGS. 10-11, the right 18 and left 19 sides of the elongated body 12 are contained in parallel vertical planes such that the cross sections of the right and left sidewalls 18*a*, 19*a* taper or thin toward their uppermost edges contained in horizontal plane 21 at the upper surface 20 of the elongated body 12. This structure, in combination with the undersized radius 26 described above and the resilient properties of the constituent material from which the sidewalls 18*a*, 19*a* are formed, advantageously enables the sidewalls 18*a*, 19*a* of the channel 24 to flex or flare around and tightly grip and securely retain the barreled action 85 when the barreled action 85 is seated in the channel 24, as illustrated in FIG. 16, without the need for epoxy or other bedding material to maintain the barreled action in the bedding block 10. This in turn prevents the formation of a high spot in the channel 24 which could cause the action to move and thereby negatively affect the accuracy during firing of the rifle.

Notably, the amount of displacement of channel sidewalls 18*a*, 19*a* is such that it does not overcome the material yield strength. Put differently, the tapered structure of channel sidewalls 18*a*, 19*a* combined with the resilient properties of the constituent material from which they are formed permits the sidewalls 18*a*, 19*a* to return to their original shape when the barreled action 85 is removed from the channel 24. This enables the sidewalls 18*a*, 19*a* of the channel 24 of the bedding block 10 to flex to fit numerous differently sized barreled actions 85 (i.e., barreled action having different radiuses or diameters) without taking on a permanently deformed shape or otherwise becoming loose, which in turn greatly extends the useful life and versatility of any stock assembly 80 of which a bedding block 10 disclosed herein is made a part.

Referring again to FIGS. 4-13, the bedding block 10 can include a notch 46 shaped to receive a bolt handle 84*a* formed in either the right 18 or left 19 side of the elongated body 12. To facilitate use of the bedding block 10 with as wide a variety of rifles as possible, the elongated body 12 can also include one or more apertures, shaped and sized to receive common operational components of a rifle, extending through the body 12 from the upper surface 20 to the lower surface 22. In some embodiments, the one or more apertures can be two apertures, including a large generally rectangular forward aperture 32 sized and shaped to receive an ammunition magazine 25, and a relatively smaller rearward aperture 30 sized and shaped to receive a trigger group 73. To enable a barreled action 85 to be releasable yet securely fastened to the bedding block 10, elongated body 12 also includes vertical forward and rearward action screw holes 40, 42, respectively, extending from the upper surface 20 to the lower surface 22.

The bedding block 10 can further advantageously include an elongated pillar 44 extending downwardly from the lower surface 22 of the rearward end 16 of the elongated body 12 for indexing the bedding block 10 to a rifle stock 70. The pillar 44 can be formed integrally the elongated body 12, or as a separate, removable member. The pillar 44 includes a hole extending longitudinally through the pillar and coaxially with the rearward action screw hole 42 in the elongated body 12 to permit an action screw 78*a* to engage an action screw hole in a lower surface of the barreled action 85 through the pillar 44. A relatively shorter pillar 45 through which forward action screw hole 40 extends projects downwardly from the lower surface 22 of the forward end 14 of the elongated body 12. The presence of pillars 44, 45 on the lower surface 22 of elongated body 12 also serves to elongate action screw holes 42, 40 and thereby to prevent the formation of accuracy-reducing high spots around the action screw holes in the lower surface of the barreled action 85.

Figure 3:
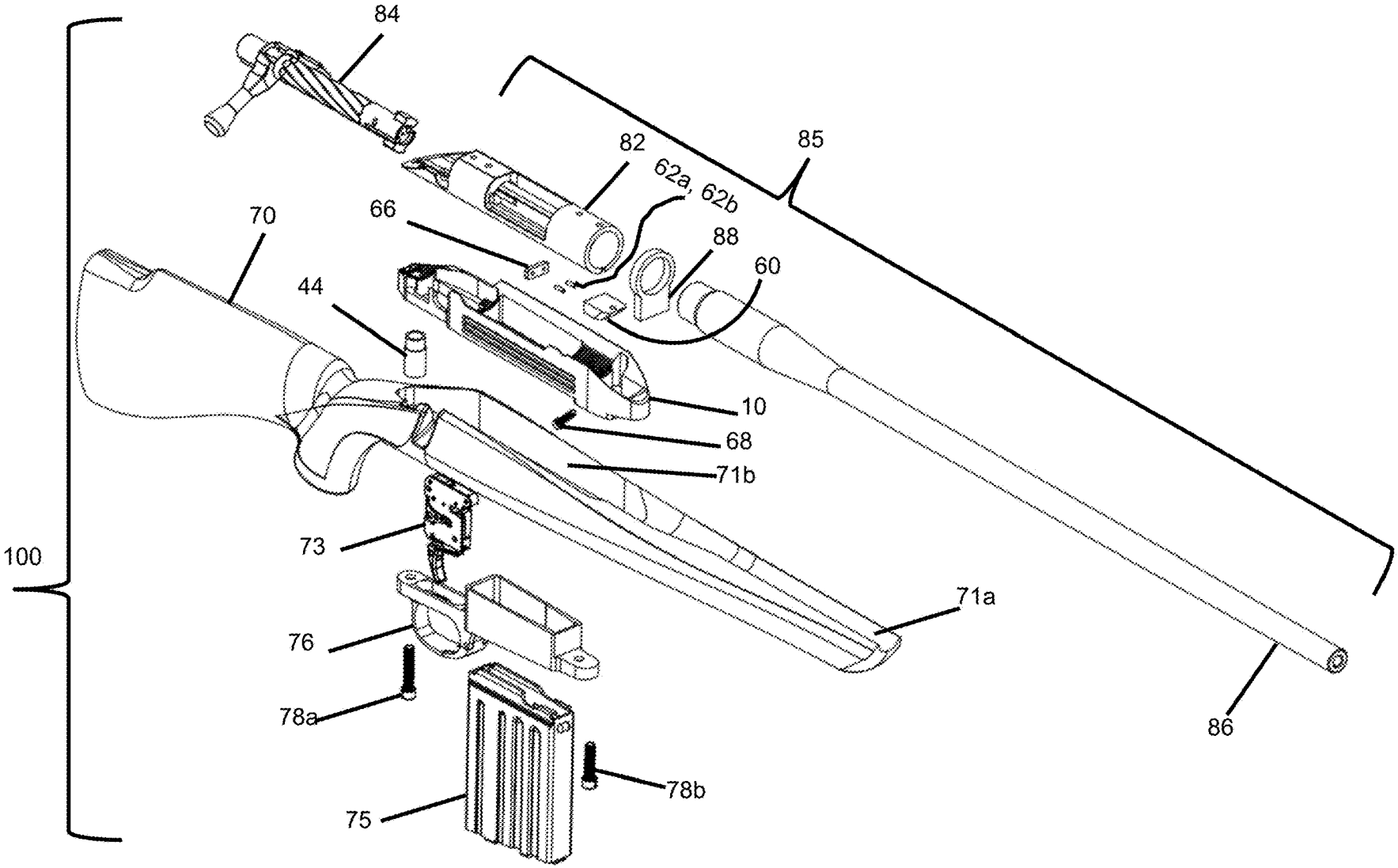
FIG. 3 is an exploded perspective view of the rifle shown in FIG. 2.
Figure 4:
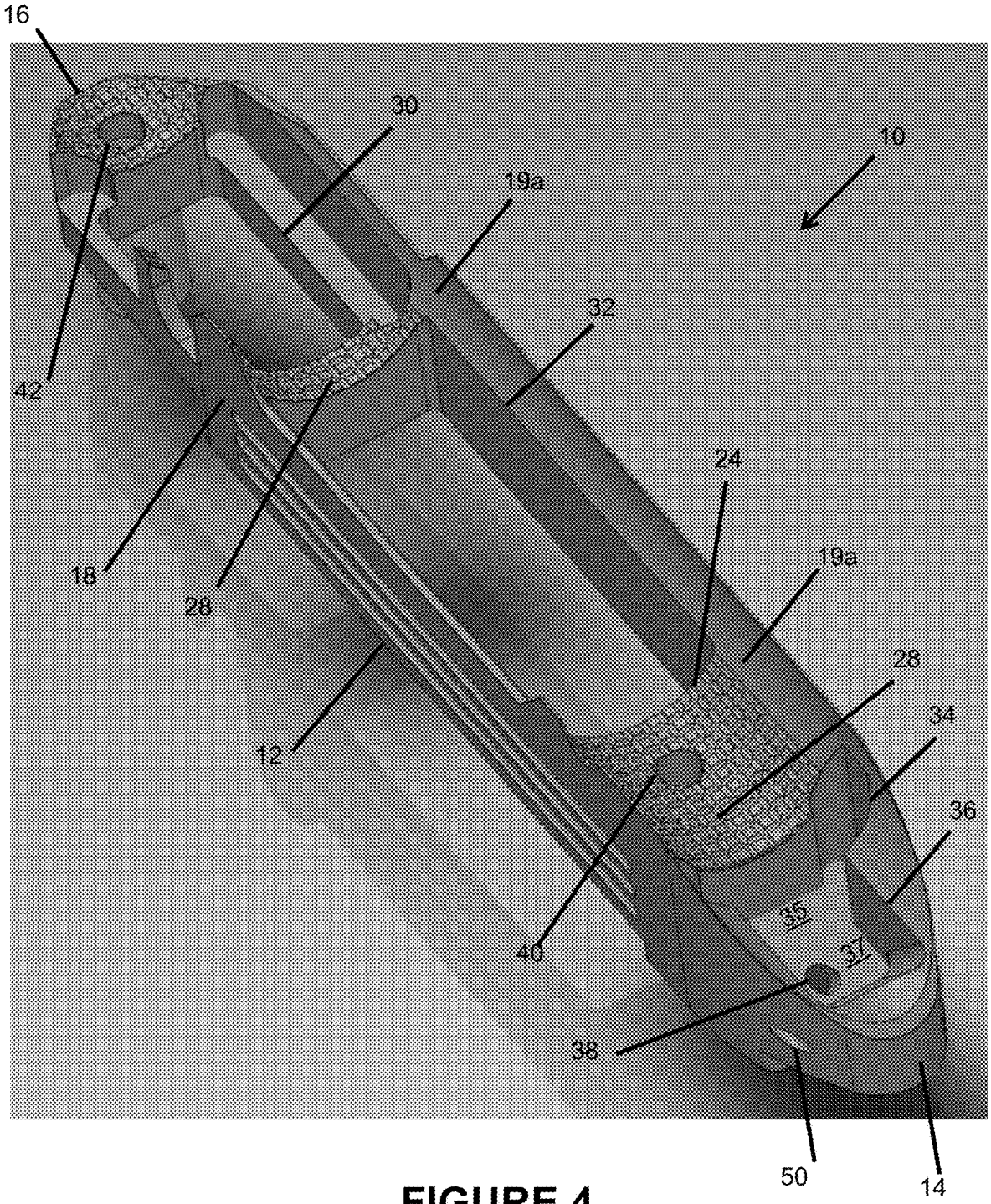
FIG. 4 is a right side elevated front perspective view of a bedding block for a rifle formed in accordance with an embodiment of the present disclosure.
Figure 5:
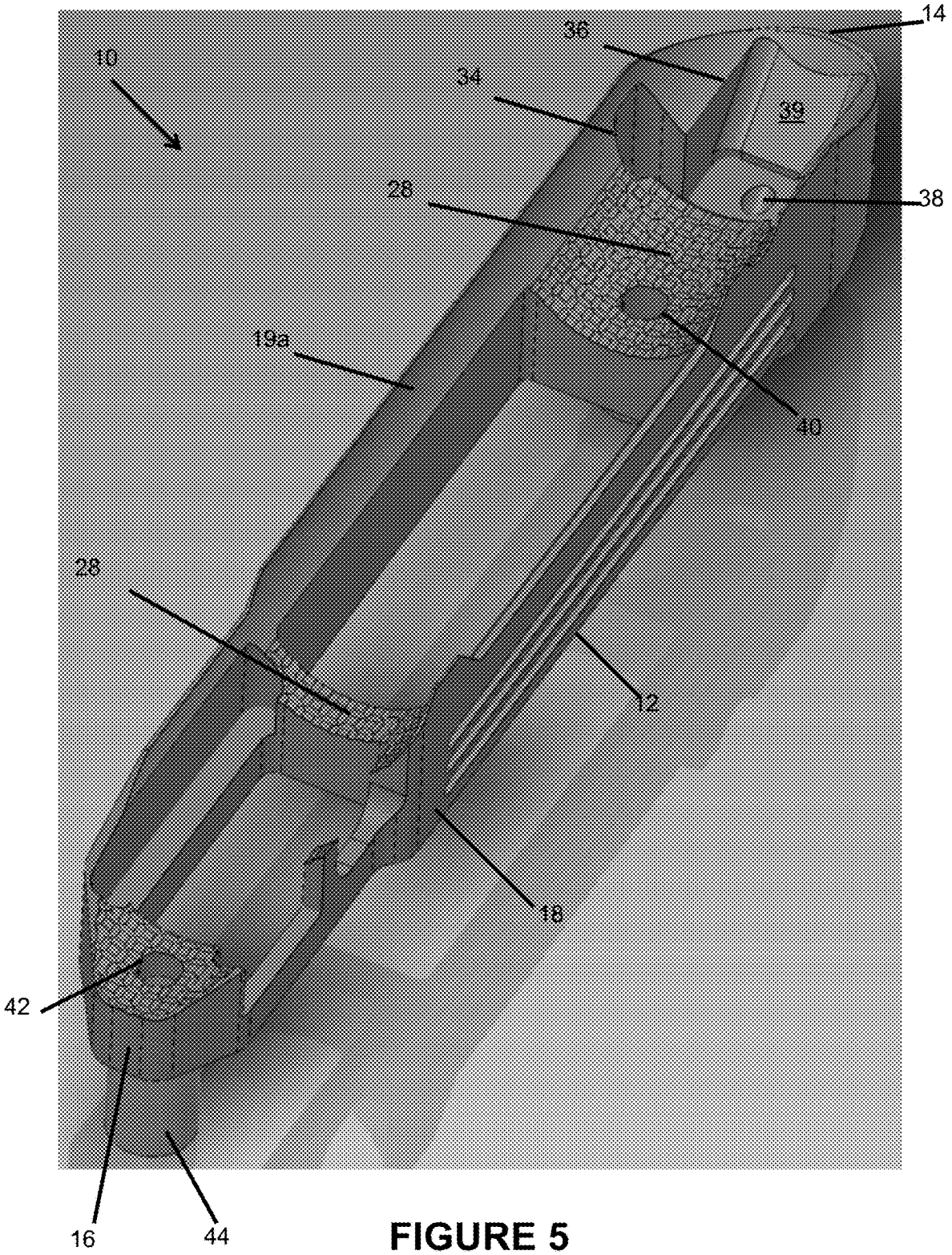
FIG. 5 is a right side elevated rear perspective view of the bedding block of FIG. 4.
Figure 6:
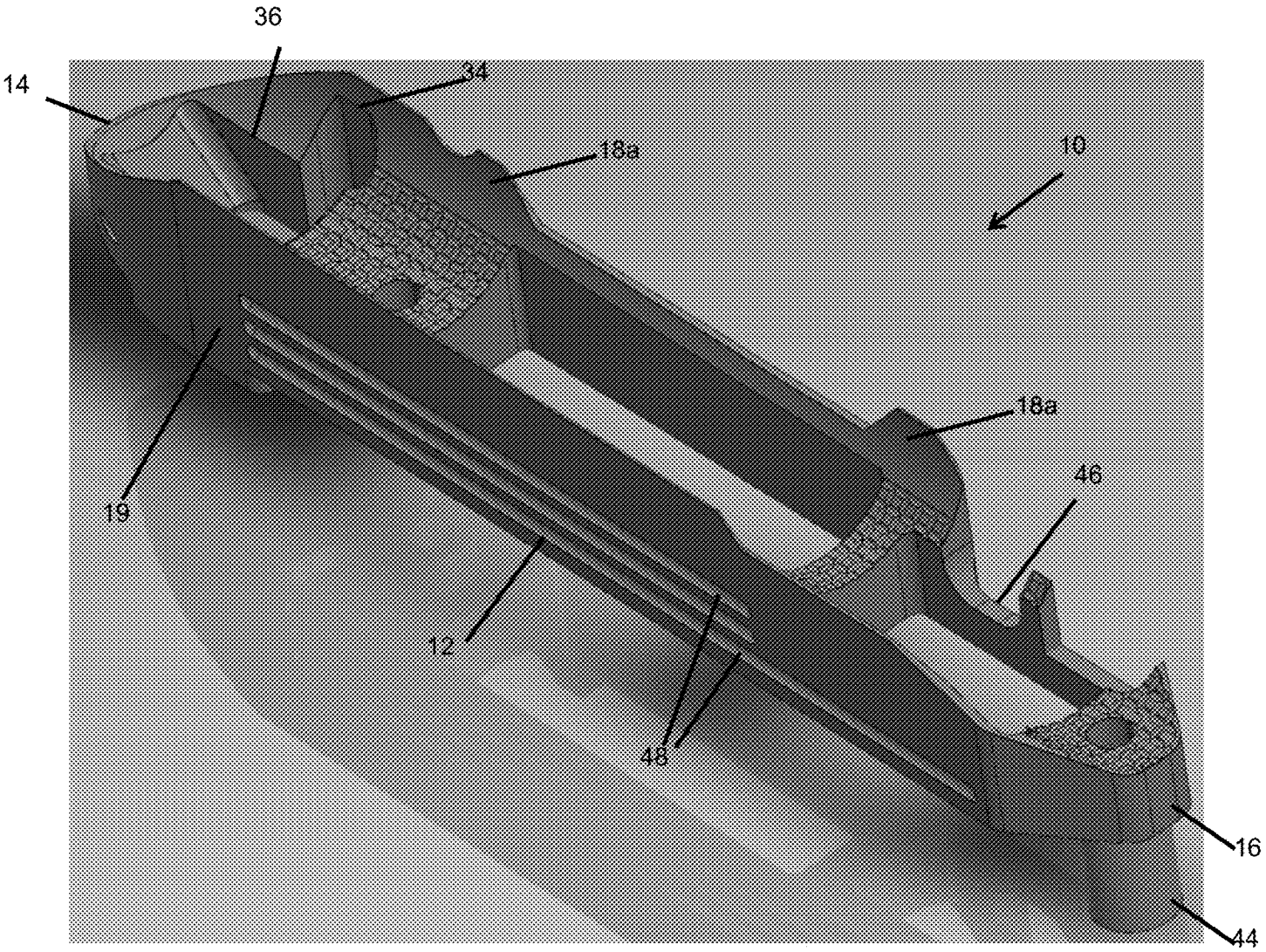
FIG. 6 is a left side elevated rear perspective view of the bedding block of FIG. 4.
Figure 7:
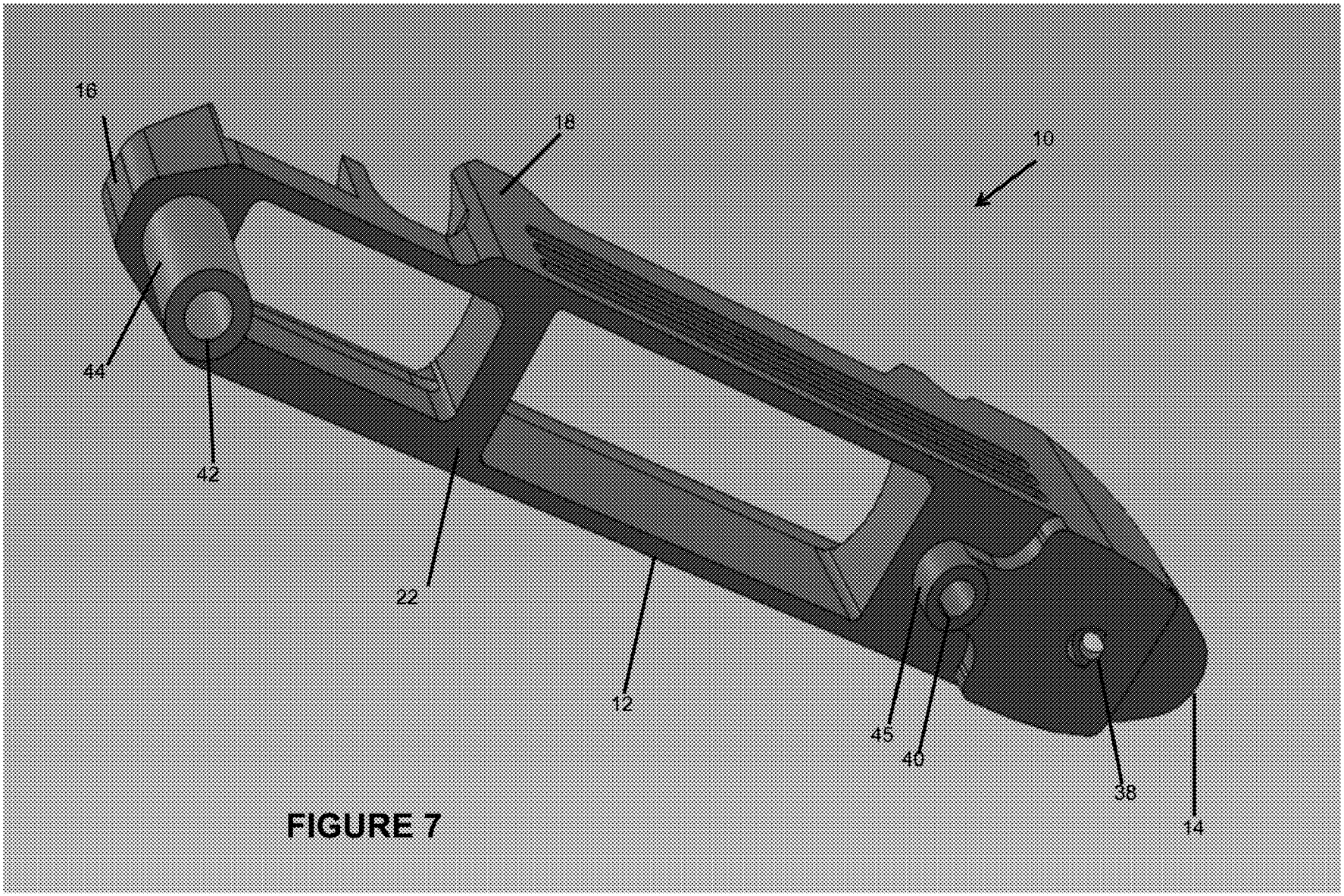
FIG. 7 is a right side depressed perspective view of the bedding block of FIG. 4.
Figure 14:
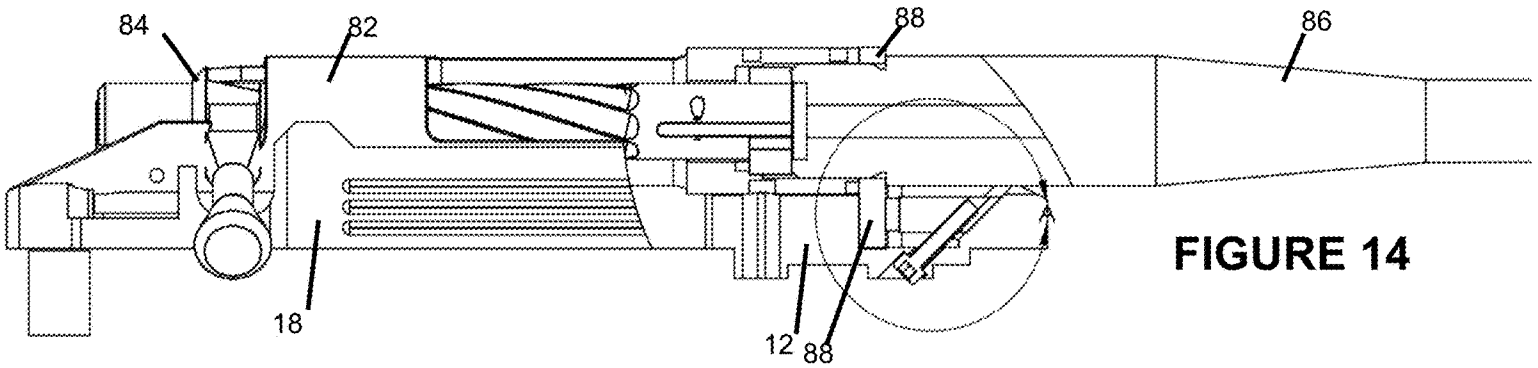
FIG. 14 is a right side partial sectional view of a barreled action for a bolt action rifle fastened in the bedding block of FIG. 4 by a clamping assembly formed in accordance with an embodiment of the present disclosure.
Figure 15:
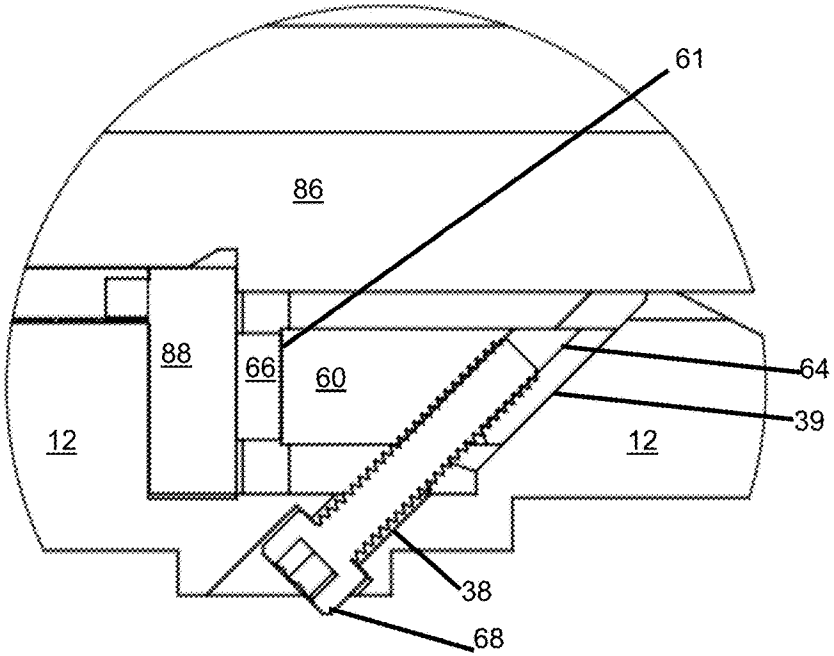
FIG. 15 is an enlarged view of the inset of FIG. 14 illustrating the application of a compressive retaining force to the recoil lug of the barreled action by the wedge member of the clamping assembly.

Referring now to FIGS. 3, 14, and 15, in some embodiments, a bedding block 10 disclosed herein can also include a clamp assembly configured to selectively apply a compressive retaining force to the recoil lug 88 of the barreled action 85 when the barreled action 85 is received in the channel 24 of elongated body 12. The clamp assembly can include a wedge member 60 and a clamp screw 68 having a head and an elongated portion. The wedge member 60 can have a top surface, a bottom surface, let and right sides, a generally vertical rear surface 61, and an upwardly sloped forward surface spaced from the vertical rear surface 61 such that the wedge member 60 has a cross section generally forming a right trapezoid when viewed from either side (as best shown in FIG. 15). A threaded aperture 64 in which the elongated portion of the clamp screw 68 is receivable can extend through the wedge member 60 from the top surface to the bottom surface along a vector parallel to the slope of the upwardly sloped forward surface of the wedge member 60. The slope of the upwardly sloped forward surface can correspond to an angle ranging from more than 0 to less than 90 degrees. In some embodiments, the angle can range from about 22.5 degrees to about 67.5 degrees. In a particular embodiment, the angle can be about 45 degrees.

The elongated body 12 can also include recesses in which the separable components of the clamp assembly are receivable. For example, a recoil lug slot 34 in which the recoil lug 88 of the barreled action 85 is receivable can be formed in a forward portion of the elongated body 12. A clamp assembly or wedge member recess 36 can be similarly formed in the forward portion of the elongated body 12 adjacent to and forward of the recoil lug slot 34. The recoil lug slot 34 can have a floor 35, as can the wedge member recess 36. The surface of the wedge member recess floor 37 can be substantially coplanar with the surface of the recoil lug slot floor 35. The wedge member recess 36 can also include an inclined or sloped forward surface or wall 39, and a through hole 38 spaced rearwardly of wall 39 extending from the wedge member recess floor 37 to the lower surface 22 of elongated body 12. The through hole 38 can be concentric with the threaded aperture 64 of the wedge member 60 when the wedge member is received in the wedge member recess 36.

The clamp assembly can be activated by selectively threading the clamp screw 68 into or out of the threaded aperture 64 in the wedge member 60 when the clamp screw 68 extends through the through hole 38 in the floor 37 of the wedge member recess 36. Tightening the clamp screw 68 while the recoil lug 88 is received in the recoil lug slot 34 translates the wedge member 60 down the sloped forward wall 39 of the wedge member recess 36 and rearwardly against the forward surface of the recoil lug 88 to simultaneously apply a downward and rearward compressive retaining force to the recoil lug 88, thereby trapping the recoil lug 88 in the recoil lug slot 34 and reducing the amount of vibration transmitted to the action screws upon firing of the rifle. Conversely, loosening the clamp screw 68 translates the wedge member 60 up the sloped forward wall 39 of the wedge member recess 36 to relieve the compressive retaining force and release the recoil lug 88 from the recoil lug slot 34.

The recoil lugs 88 of different barreled actions 85 are not uniformly sized. Accordingly, to increase the versatility of the bedding block 10 and facilitate retention of differently sized (including especially thin) recoil lugs, the clamp assembly can further include an extension piece or adaptor plate 66 and a pair of fasteners 62*a*, 62*b* for fastening the adaptor plate 66 to the vertical rear surface 61 of the wedge member 60. Once fastened to the wedge member 60, the adaptor plate 66 serves to extend the wedge member further rearward than the wedge member would otherwise extend, even if translated all the way down the sloped forward wall 39 of wedge member recess 36 to floor 37.

The forward portion of the elongated body 12 can also advantageously include a relief radius rearward of and adjacent to the recoil lug slot 34 to allow barreled actions 85 with abnormally large integral recoil lugs to sit flush on the bottom surface 28 of the channel 24 without the need for custom gunsmithing to relieve implicated areas.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful BEDDING BLOCK FOR A RIFLE, it is not intended that such references be construed as limitations upon the scope of this invention except as set forth in the following claims.

What is claimed is:

1. A bedding block for mounting a barreled action for a rifle to a stock, comprising:

an elongated body configured to receive the barreled action for the rifle in a channel of the elongated body, wherein:

the channel extends along a length of the elongated body, the channel has a generally semicircular cross section, the semicircular cross section has a radius and a center of curvature, a portion of the barreled action configured to interface with the elongated body defines another radius, the radius of the semicircular cross section is less than the radius of the barreled action, the channel includes opposing left and right sidewalls, a portion of each of which extends upwardly above the center of curvature, and the left and right sidewalls of the channel flex around the barreled action during introduction of the barreled action into the channel grip the barreled action in an interference fit when the barreled action is seated in the channel, and contact the barreled action above the center of curvature to retain the barreled action in the channel.

2. The bedding block of claim 1, wherein the channel is defined in an upper surface of the elongated body.

3. The bedding block of claim 2, wherein the center of curvature is below a horizontal plane containing the upper surface of the elongated body.

4. The bedding block of claim 1, wherein a portion of each of the left and right sidewalls extends above the center of curvature from about 0.005 to about 0.030 inches.

5. The bedding block of claim 1, wherein the left and right sidewalls of the channel return to an original rest position when the barreled action is removed from the channel.

6. The bedding block of claim 1, wherein:

the portion of each of the left and right sidewalls extending upwardly above the center of curvature grips the barreled action in the interference fit when the barreled action is seated in the channel.

7. The bedding block of claim 1, wherein the radius of the semicircular cross section of the channel is from about 0.25% to about 10% less than the radius of the barreled action.

8. The bedding block of claim 1, wherein the radius of the semicircular cross section of the channel is about 0.25 to about 1.50 inches.

9. The bedding block of claim 1, wherein a bottom surface of the channel includes textural features configured to interface with the portion of the barreled action defining the radius of the barreled action.

10. The bedding block of claim 1, further comprising a clamp assembly configured to selectively apply a compressive retaining force to a recoil lug of the barreled action when the barreled action is received in the channel of the elongated body.

11. The bedding block of claim 10, wherein:

the clamp assembly comprises:

a threaded fastener having a head portion and an elongated portion, a wedge member having top surface, a bottom surface, a generally vertical rear surface, a forward surface spaced from the rear surface, the forward surface having an upward slope, and a threaded aperture in which the elongated portion of the threaded fastener is matingly receivable extending parallel to the slope of the forward surface upward from the bottom surface to the top surface, a slot in which the recoil lug of the barreled action is receivable defined in a forward portion of the elongated body, a recess in which the wedge member is receivable defined in the forward portion of the elongated body forward of and adjacent to the slot, the recess having an upwardly sloped forward wall, and a through hole extending from a bottom surface of the elongated body to a floor of the recess, the through hole sharing an axis with the threaded aperture when the wedge member is received in the recess; and selectively tightening the threaded fastener when the recoil lug is received in the slot and the threaded fastener extends through the through hole and into the threaded aperture of the wedge member translates the wedge member down the sloped forward wall of the recess to apply a compressive retaining force to the recoil lug.

12. The bedding block of claim 11, wherein the clamp assembly further includes an adaptor plate and at least one fastener for fastening the adaptor plate to the vertical rear surface of the wedge member.

13. A stock assembly configured to mount a barreled action for a rifle, the stock assembly comprising:

a stock having an elongated recess defined in an upper surface thereof; and a bedding block rigidly secured in the elongated recess of the stock, the bedding block including an elongated body configured to receive the barreled action for the rifle in a channel defined in the elongated body, wherein:

the channel has a first radius, the barreled action has a second radius, the first radius is less than the second radius, the channel extends along a length of the elongated body, the channel has a semicircular cross section, the semicircular cross section of the channel defines the first radius, the second radius is defined by a portion of the barreled action that interfaces with the channel, the semicircular cross section of the channel has a center of curvature, and the channel includes opposing left and right sidewalls that extend upwardly above the center of curvature and contact the barreled action above the center of curvature to retain the barreled action in the channel.

14. The stock assembly of claim 13, further comprising:

a clamp assembly configured to selectively apply a compressive retaining force to a recoil lug of the barreled action when the barreled action is received in the channel of the elongated body, wherein the clamp assembly includes:

a threaded fastener having a head portion and an elongated portion, a wedge member having top surface, a bottom surface, a generally vertical rear surface, a forward surface spaced from the rear surface, the forward surface having an upward slope, and a threaded aperture in which the elongated portion of the threaded fastener is matingly receivable extending parallel to the slope of the forward surface upward from the bottom surface to the top surface, a slot in which the recoil lug of the barreled action is receivable defined in a forward portion of the elongated body, a recess in which the wedge member is receivable defined in the forward portion of the elongated body forward of and adjacent to the slot, the recess having an upwardly sloped forward wall, and a through hole extending from a bottom surface of the elongated body to a floor of the recess, the through hole sharing an axis with the threaded aperture when the wedge member is received in the recess;

wherein selectively tightening the threaded fastener when the recoil lug is received in the slot and the threaded fastener extends through the through hole and into the threaded aperture of the wedge member translates the wedge member down the sloped forward wall of the recess to apply a compressive retaining force to the recoil lug.

15. The stock assembly of claim 13, wherein:

a portion of each of the left and right sidewalls extending upwardly above the center of curvature grips the barreled action in the interference fit when the barreled action is seated in the channel.

16. A method of mounting a barreled action for a rifle to a stock, comprising:

providing a bedding block including an elongated body configured to receive the action for the rifle in a semicircular channel defined in the elongated body, wherein the channel has a first radius, the barreled action has a second radius, and the first radius is less than the second radius;

providing a stock having a recess in which the bedding block is receivable;

securing the bedding block in the recess of the stock; and fastening the barreled action for the rifle in the channel of the bedding block, wherein:

the channel of the bedding block extends along a length of the elongated body, the channel has a semicircular cross section, the semicircular cross section of the channel has a center of curvature, the semicircular cross section of the channel defines the first radius, a portion of the barreled action interfaces with three different portions of a bottom surface of the channel, the second radius is defined by the portion of the barreled action which interfaces with the bottom surface of the channel, and the channel includes opposing left and right sidewalls that contact the barreled action above the center of curvature to retain the barreled action in the channel.

17. The method of claim 16, wherein:

a portion of each of the left and right sidewalls extending upwardly above the center of curvature grips the barreled action in the interference fit when the barreled action is seated in the channel.

* * * * *